United States Patent [19]

Goto

[11] Patent Number: 5,044,792

[45] Date of Patent: Sep. 3, 1991

[54] COMPACT TYPE BELT MICROPRINTER

[75] Inventor: Atsushi Goto, Iwate, Japan

[73] Assignee: Alps Electric Co., Ltd., Tokyo, Japan

[21] Appl. No.: 383,956

[22] Filed: Jul. 21, 1989

[30] Foreign Application Priority Data

Aug. 26, 1988 [JP] Japan ..... 63-212258

[51] Int. Cl.[5] ..... B41J 1/20

[52] U.S. Cl. ..... 400/146; 400/185; 400/569; 101/93.13; 101/111

[58] Field of Search ..... 400/146, 145.1, 145.2, 400/185, 186, 187, 569; 101/93.14, 93.13, 105, 111

[56] References Cited

U.S. PATENT DOCUMENTS

| | | | |
|---|---|---|---|
| 3,793,951 | 2/1974 | Denley | 400/146 |
| 4,386,863 | 6/1983 | Rooney | 400/146 |
| 4,443,123 | 4/1984 | Ono et al. | 400/146 |
| 4,455,936 | 6/1984 | Hori | 400/146 |
| 4,715,737 | 12/1987 | Hori | 400/569 |
| 4,778,294 | 10/1988 | Taniguchi | 400/146 |

FOREIGN PATENT DOCUMENTS

| | | | |
|---|---|---|---|
| 105571 | 4/1980 | Japan | 400/146 |
| 92086 | 7/1981 | Japan | 400/146 |
| 129179 | 7/1984 | Japan | 400/146 |

*Primary Examiner*—Clifford D. Crowder
*Assistant Examiner*—Joseph R. Keating
*Attorney, Agent, or Firm*—Guy W. Shoup; David W. Heid

[57] ABSTRACT

A microprinter for use in combination with such compact equipments as electronic calculator. The microprinter comprises a type belt driven through a belt pulley by a motor, a type selecting ratchet wheel combined with the belt pulley for rotation together with the latter, a hammer for pressing a selected type of the type belt to print the type on a recording sheet, a main printing gear driven by the motor, a selector lever capable of selectively engaging the type selecting ratchet wheel or the main printing gear, an armature plate associated with the selector lever, an electromagnetic clutch for driving the armature plate, and a sheet feed lever interlocked through the armature plate with the electromagnetic clutch. The motor drives sheet feed rollers for rotation through a LF clutch gear and a LF cam, the sheet feed lever is driven for turning through the armature plate and the electromagnetic clutch by the motor while the same is released from the limiting plate for limiting the swing motion of the sheet feed lever, the sheet feed lever is driven through the armature plate and the electromagnetic clutch by the motor so that the retaining pawl thereof engages a recess formed in the LF clutch gear to restrain the LF clutch gear from rotation, and the sheet feed lever is allowed to return to its home position when the armature plate is released from the electromagnetic clutch so that the retaining pawl thereof is disengaged from the recess of the LF clutch gear to allow the LF clutch gear to rotate.

1 Claim, 6 Drawing Sheets

COMPACT TYPE BELT MICROPRINTER

BACKGROUND OF THE INVENTION

1. Field of the Invention

The present invention relates to a microprinter and, more particularly, to a microprinter having a type belt for printing, for use in combination with an electronic calculator.

2. Description of the Prior Art

The microprinter having a type belt for printing has been applied to various equipment, particularly, small equipment, such as electronic calculators.

The conventional microprinter comprises a type belt, a driving belt pulley for driving the type belt, a motor for driving the driving belt pulley, a hammer supported for movement along a printing line to press a type on the type belt located at a printing position against a recording sheet, a ratchet wheel fixedly combined with the driving belt pulley for rotation together with the driving belt pulley, a main gear supported coaxially with the ratchet wheel for individual rotation to drive the hammer, a selector lever capable of selectively engaging the ratchet wheel or the main gear, and an electromagnetic clutch for controlling the motion of the selector lever.

The selector lever is engaged with the main gear to restrain the main gear, and then the motor is actuated to select a desired type by rotating the ratchet wheel and the driving belt pulley. Then, a current is supplied to the electromagnetic clutch to release the main gear from the selector lever and to engage the selector lever with the ratchet wheel to restrain the ratchet wheel. In this state, the motor drives the main gear to drive the hammer to press the selected type against the recording sheet for printing.

After the printing operation for one line has been completed, a current is supplied to the electromagnetic clutch and another electromagnetic clutch to transmit the rotative force of the motor to a sheet feed mechanism to feed the recording sheet by a distance corresponding to a line space.

Thus the conventional microprinter is provided with two electromagnetic clutches respectively for the printing mechanism and the sheet feed mechanism to drive the two mechanisms by a single motor.

However, since electromagnetic clutches require a comparative large space for installation, the provision of two electromagnetic clutches in a limited space is an impediment to forming the microprinter in a compact structure, which is essential to the microprinter, requires a comparatively large number of parts and increases the manufacturing cost of the microprinter.

SUMMARY OF THE INVENTION

Accordingly, it is an object of the present invention to provide a microprinter having a control mechanism of a compact construction including a single electromagnetic clutch and capable of operating two mechanisms.

The foregoing object is achieved by a microprinter comprising: a type belt carrying a plurality of types; a driving belt pulley for driving the type belt; a motor for driving the driving belt pulley; a type selecting ratchet wheel combined with the driving belt pulley for rotation together with the latter; a hammer for pressing a selected type of the type belt to print the type on a recording sheet; a main printing gear driven by the motor to drive the hammer for printing; a selector lever capable of selectively engaging the type selecting ratchet wheel or the main printing gear; an armature plate associated with the selector lever; an electromagnetic clutch for driving the armature plate; and a sheet feed lever interlocked through the armature plate with the electromagnetic clutch. The motor drives sheet feed rollers for rotation through a LF clutch gear and a LF cam to feed the recording sheet, the sheet feed lever is driven for turning through the armature plate and the electromagnetic clutch by the motor while the same is released from a limiting plate for limiting the swing motion of the sheet feed lever, the sheet feed lever has a retaining pawl, the sheet feed lever is driven through the armature plate and the electromagnetic clutch by the motor so that the retaining pawl thereof engages a recess formed in the LF clutch gear to restrain the LF clutch gear from rotation, and the sheet feed lever is allowed to return to its home position when the armature plate is released from the electromagnetic clutch so that the retaining pawl thereof is disengaged from the recess of the LF clutch gear to allow the LF clutch gear to rotate.

Thus, the selector lever and the sheet feed lever are connected to the armature plate to drive the selector lever for type selection and printing and to drive the sheet feed lever for feeding the recording sheet by the single electromagnetic clutch. Accordingly, the microprinter of the present invention needs a space for only a single electromagnetic clutch and hence the same has a compact construction.

BRIEF DESCRIPTION OF THE DRAWINGS

The above and other objects, features and advantages of the present invention will become more apparent from the following description taken in conjunction with the accompanying drawings, in which.

DETAILED DESCRIPTION OF THE PREFERRED EMBODIMENT

Figure 1:
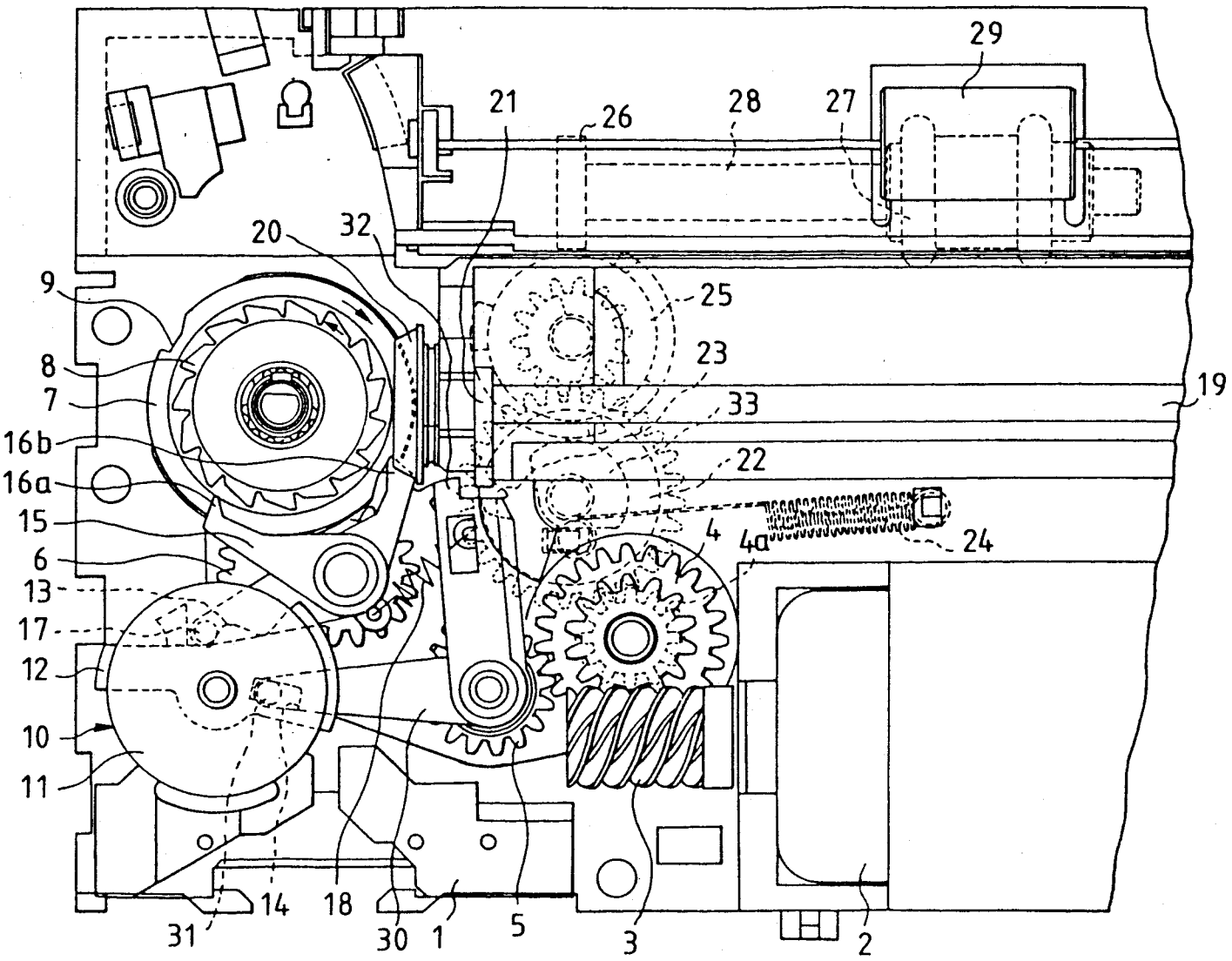
FIG. 1 is a fragmentary plan view of a microprinter embodying the present invention.
Figure 2:
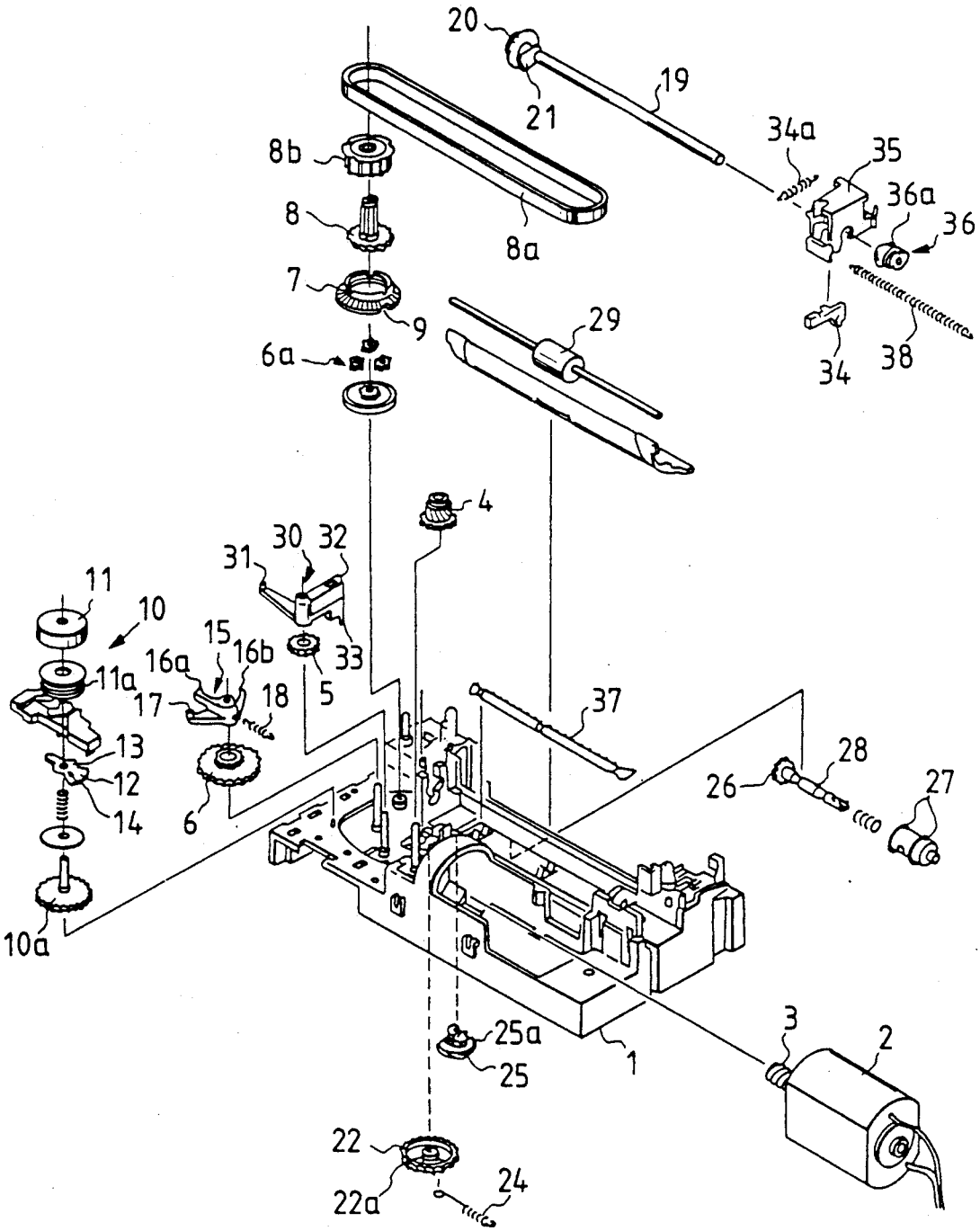
FIG. 2 is a fragmentary perspective view of the microprinter of FIG. 1.

Referring to FIGS. 1 and 2, a microprinter in a preferred embodiment according to the present invention has a motor 2 fixed to a frame 1. A first idle gear 4, a second idle gear 5 and a third idle gear 6 are engaged sequentially to form a gear train. A worm 3 fixed to the output shaft of the motor 2 engages the first idle gear 4 of the gear train. The third idle gear 6 engages a planetary gear train **6*a* disposed at the left end, as viewed in FIG. 2, of the frame 1. A main printing gear 7, i.e. a bevel gear, and a ratchet wheel 8 are joined coaxially to the planetary gear train 6a. Cam edges 9 are formed diametrically symmetrically in the circumference of the main printing gear 7. A driving belt pulley 8b for driving a type belt 8a is joined to the ratchet wheel 8 for rotation together with the ratchet wheel 8. The main printing gear 7 and the ratchet wheel 8 are rotated respectively in opposite directions by the planetary gear train 6a. That is, the ratchet wheel 8 is rotated counterclockwise, as viewed in FIG. 1, and the main printing gear 7 is rotated clockwise, as viewed in FIG. 1**.

The third idle gear 6 engages the clutch gear 10a of an electromagnetic clutch 10. A yoke 11 internally provided with a solenoid coil 11a is mounted coaxially on the electromagnetic clutch 10 so as to be rotated by the clutch gear 10a. An armature plate 12 is disposed under the yoke 11 so as to be attracted to the yoke 11 when the solenoid coil 11a is energized. The armature plate 12 is provided with a cam edge 13 in a portion of the circumference thereof, and a through hole 14 in the body portion thereof. A trifurcate selector lever 15 having two retaining pawls 16a and 16b and a finger 17 is mounted rotatably on the boss of the third idle gear 6. The retaining pawls 16a and 16b of the selector lever 15 are engaged selectively respectively with the tooth of the ratchet wheel 8 and the cam edge 9 of the main printing gear 7, and the finger 17 of the selector lever 15 engages the cam edge 13 of the armature plate 12. An extension spring 18 is extended between the selector lever 15 and a bifurcate sheet feed lever 30 so as to bias both the selector lever 15 and the sheet feed lever counterclockwise, as viewed in FIG. 1. When the selector lever 15 is at the home position, the retaining pawl 16a is separated from the ratchet wheel 8 while the other retaining pawl 16b is in engagement with the cam edge 9 of the main printing gear 7.

The main printing gear 7 engages a spacing gear 20, i.e., a bevel gear, attached to one end of a driving shaft 19 extended in parallel to the direction of movement of a hammer holding block 35. A substantially sectorial limiting plate 21 is attached to the driving shaft 19 near the spacing gear 20. The hammer holding block 35 holding a hammer 34 is axially slidably mounted on the driving shaft 19. A cam 36 for driving the hammer 34 is mounted on the driving shaft 19 to drive the hammer 34 when the driving shaft 19 is rotated.

An idle gear 4a formed integrally with the first idle gear 4 engages a LF clutch gear 22 having a deficient portion 22a. When the LF clutch gear 22 is at the home position, the deficient portion 22a is opposite the idle gear 4a, so that the rotation of the idle gear 4a is not transmittede to the LF clutch gear 22. A projection 23 is fomed in the peripheral portion of the upper surface of the LF clutch gear 22. A projection 33 formed on the bifurcate sheet feed lever 30 engages the projection 23 of the LF clutch gear 22 to restrain the LF clutch gear 22 from rotation. A spring 24 has one end connected to the frame 1 and the other end connected to the LF clutch gear 22 to apply a torque biasing the LF clutch gear 22 in a counterclockwise direction as viewed in FIG. 1. The LF clutch gear 22 is in engagement also with a gear 25a formed coaxially and integrally with a LF cam 25 provided with a partial worm in a portion of the circumference thereof. A sheet feed worm wheel 26 attached to one end of a shaft 28 extending in parallel to the driving shaft 19 and disposed in the rear section of the frame 1 engages the partial worm of the LF cam 25. Rubber sheet feed rollers 27 are mounted on the shaft 28. A pressure roller 29 is pressed against the sheet feed rollers 27 to hold a recording sheet therebetween.

The bifurcate sheet feed lever 30 is mounted swingably on a shaft on which the second idle gear 5 is mounted. One of the arms of the bifurcate sheet feed lever 30 is provided at the extremity thereof with a projection 31 formed so as to engage the through hole 14 of the armature plate 12, and the other arm of the same is provided at the extremity thereof with an upper projection 32 formed so as to engage the limiting plate 21 and the lower projection 33 formed so as to engage the projection 23 of the LF clutch gear 22 to restrain the LF clutch gear 22 from rotation.

The operation of the microprinter thus constructed will be described hereinafter with reference to FIGS. 3 to 7.

Figure 3:
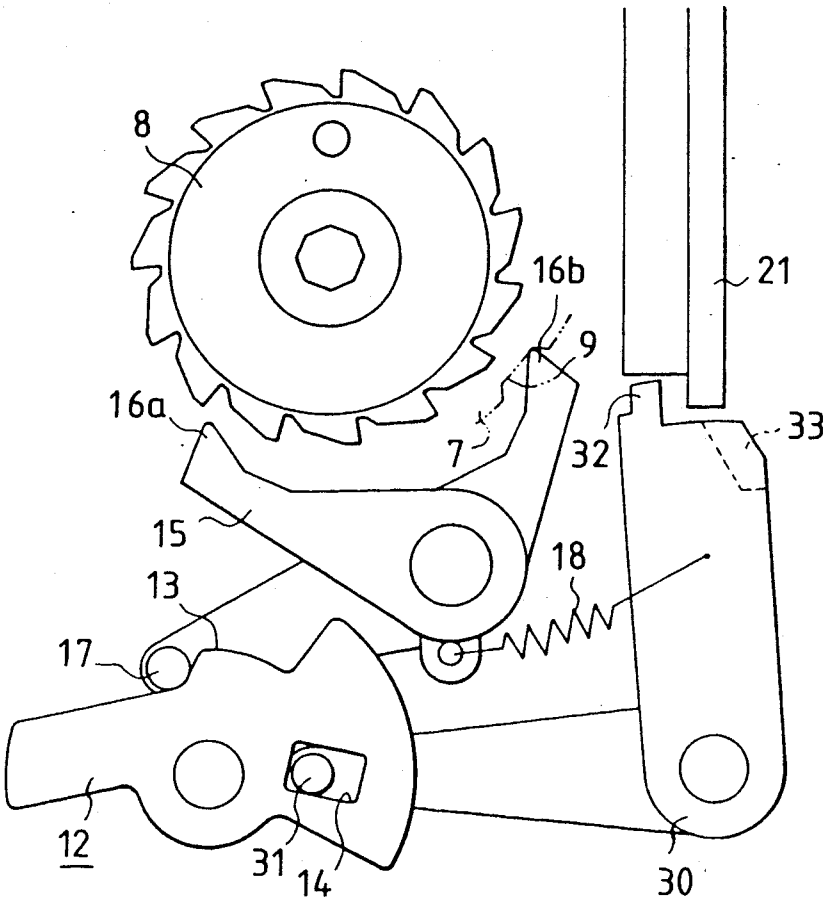
FIG. 3 is a schematic view illustrating a selector lever and a sheet feed lever respectively at the home positions.
Figure 7:
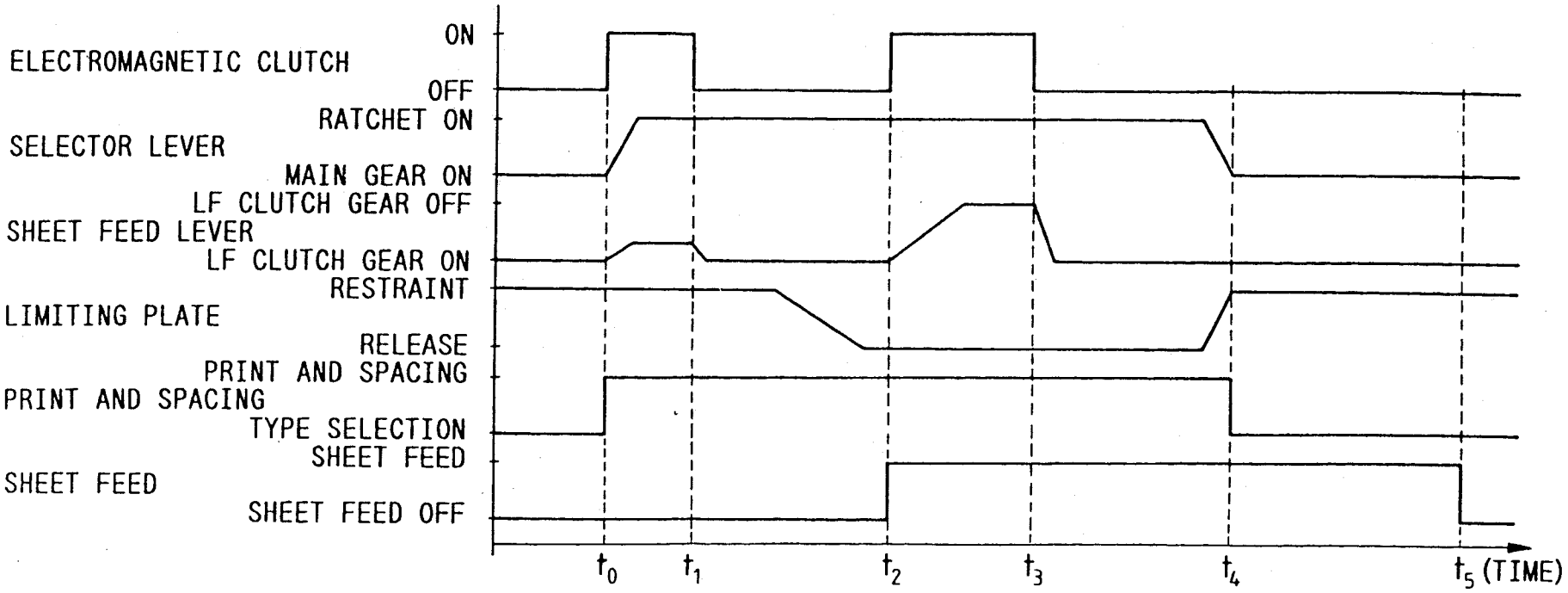
FIG. 7 is a time chart of assistance in explaining a control operation for sheet feeding.

Referring to FIGS. 3 and 7, in a state where the components of the microprinter are at the respective home positions, namely, during a period before time $t_0$, the retaining pawl 16b of the selector lever 15 is disengaged from the ratchet wheel 8 while the retaining pawl 16b of the same is in engagement with the cam edge 9 of the main printing gear 7, and hence the main printing gear 7 is unable to rotate while the ratchet wheel 8 is rotatable. The lower projection 33 of the sheet feed lever 30 is in engagement with the projection 23 of the LF clutch gear 22 to restrain the LF clutch gear 22 from rotation.

Figure 4:
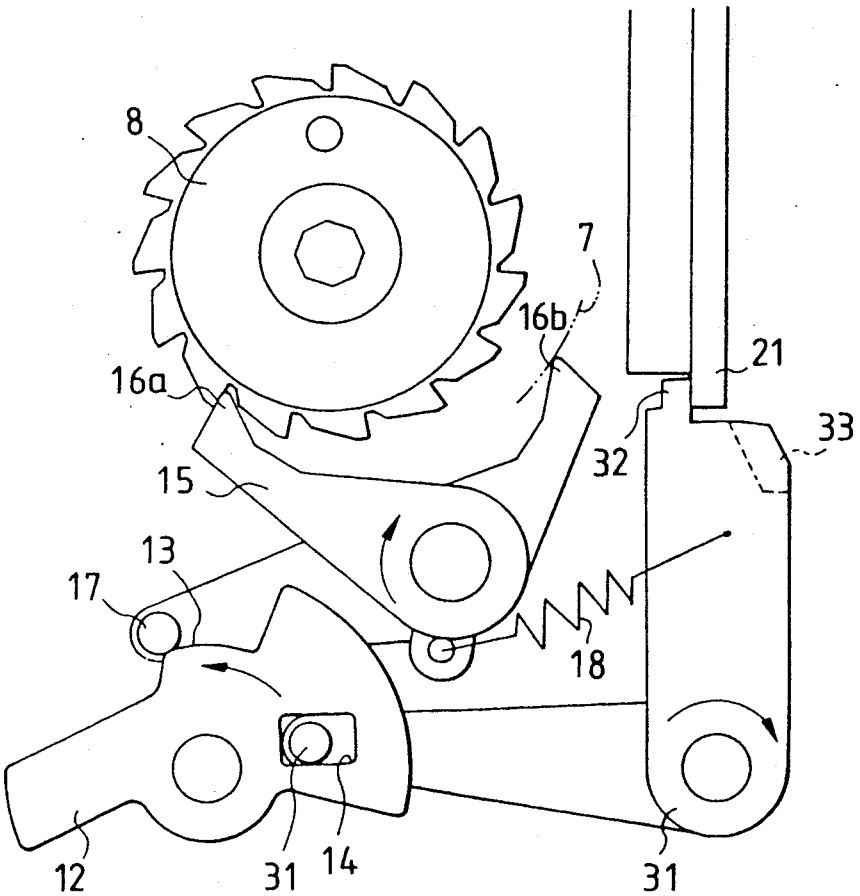
FIG. 4 is a view similar to FIG. 3, illustrating the selector lever and the sheet feed lever during a printing operation.

In selecting a desired type, the motor 2 is actuated to drive the ratchet wheel 8 and the yoke 11 of the electromagnetic clutch 10 for rotation through the worm 3 and the idle gears 4, 5 and 6. Consequently, the type belt 8a is driven for selecting the desired type by the driving pulley 8b rotated together with the ratchet 8. Upon the detection of arrival of the desired type at a printing position by a type detector, not shown, the solenoid coil of the electromagnetic clutch 10 is energized for a time between time $t_0$ and time $t_1$ to attract the armature plate 12 to the yoke 11. Then, as shown in FIG. 4, the projection 17 of the selector lever 15 is pushed toward the ratchet wheel 8 by the cam edge 13 of the armature plate 12. Thus, the selector lever 15 is turned against the resilience of the spring 18 together with the yoke until the retaining pawl 16a of the selector lever 15 engages the ratchet wheel 8 to stop the ratchet 8, and thereby the type belt 8a is stopped. At the same time, the retaining pawl 16b of the selector lever 15 is disengaged from the cam edge 9 of the main printing gear 7 to allow the main printing gear 7 to start rotating. The main printing gear 7 engaging the spacing gear 20 drives the driving shaft 19 to drive the hammer 34 with the cam 36 against the resilience of a hammer return spring 34a in order to press the desired type against the recording sheet for printing with the hammer 34 during the first half turn of the cam 36. During the second half turn of the cam 36, the cam edge 36a of the cam 36 engages a rack 37 to cause the hammer holding block 35 to move one space forward. Meanwhile, the armature plate 12 tends to turn the sheet feed lever 30 clockwise, as viewed in FIG. 3. However, the turning motion of the sheet feed lever 30 is limited by the limiting plate 21 attached to the driving shaft 19 so as to engage the upper projection 32 of the sheet feed lever 30.

At time $t_4$ after the completion of the printing operation, the cam edge 9 of the main printing gear 7 arrives at a position opposite the retaining pawl 16b of the selector lever 15. Then, the selector lever 15 is turned by the extension spring 18, so that the retaining pawl 16*b* of the selector lever 15 engages the cam edge 9 of the main printing gear 7 and the other retaining pawl 16*a* is released from the ratchet wheel 8. Subsequently, the same printing cycle is repeated for selecting a desired type, printing and spacing.

Figure 5:
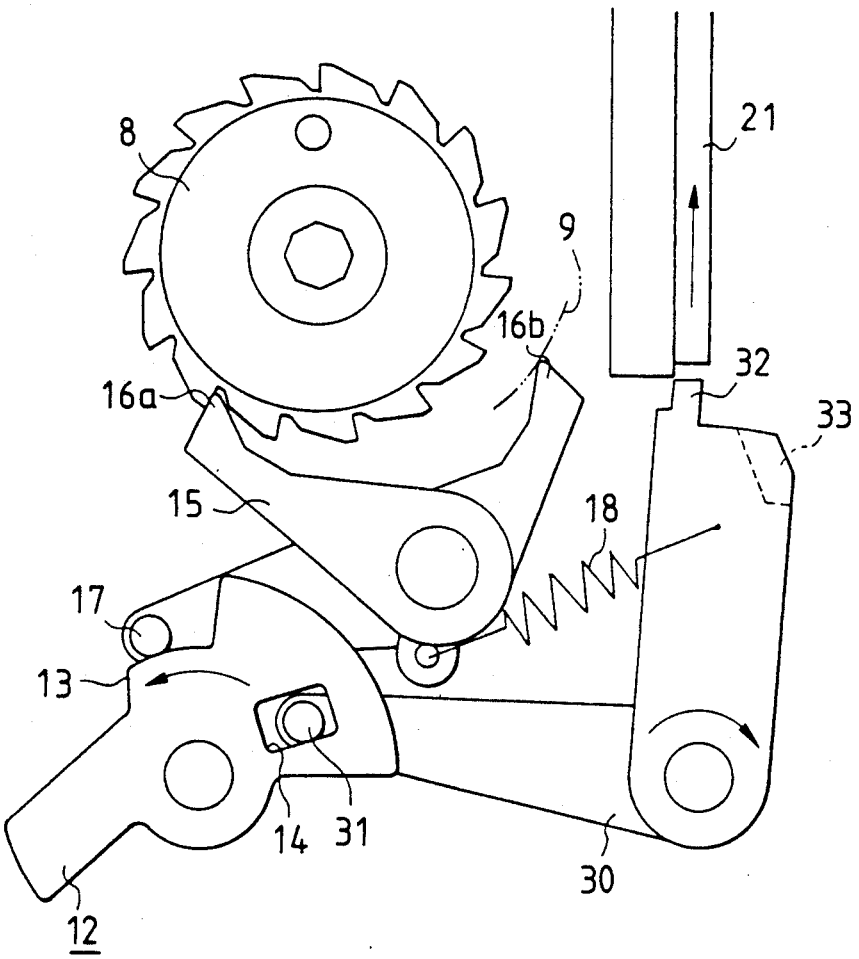
FIG. 5 is a view similar to FIG. 3, illustrating the selector lever and the sheet feed lever during a sheet feeding operation.
Figure 6:
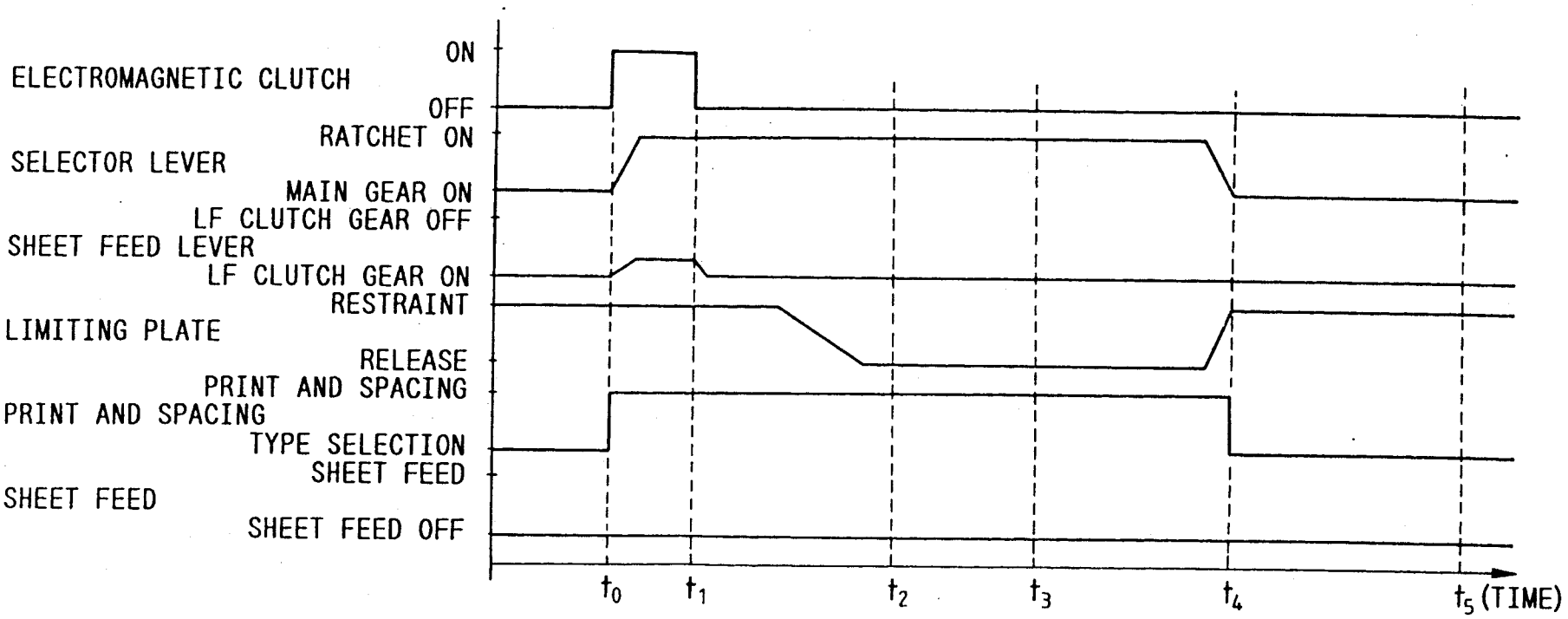
FIG. 6 is a time chart of assistance in explaining a control operation for type selection and printing.

A sheet feed operation after the completion of printing characters for one line will be described hereinafter. Referring to FIGS. 5 and 6, when the printing operation for printing the last character for the line is completed at time $t_2$, the solenoid coil 11*a* of the electromagnetic clutch 10 is energized for a time between time $t_2$ and time $t_3$ to turn the sheet feed lever 30 by the armature plate 12, while the limiting plate 21 attached to the driving shaft 19 is rotated continuously through the spacing gear 20 by the main printing gear 7 to allow the sheet feed lever 30 to be turned. While the sheet feed lever 30 is being turned, the retaining pawl 16*b* of the selector lever 15 is in contact with the circumference of the main printing gear 7 while the retaining pawl 16*a* of the same is in engagement with the ratchet wheel 8. Therefore, the motion of the selector lever 15 is not affected by the turning motion of the armature plate 12. Thus, upon the disengagement of the the lower projection 33 of the sheet feed lever 30 from the projection 23 of the LF clutch gear 22, the LF clutch gear 22 is turned counterclockwise, as viewed in FIG. 1, by the resilience of the spring 24 until the toothed section of the LF clutch gear 22 engages the idle gear 4*a* and, consequently, the LF clutch gear 22 is driven for rotation through the idle gear 4*a* by the motor 2 for a time between time $t_2$ and time $t_4$ and thereby the sheet feed lever 30 is released from the projection 23 of the LF clutch gear 22. The LF clutch gear 22 is rotated further for a time corresponding to about fifteen times the period between the time $t_0$ and time $t_1$ to rotate the sheet feed rollers 27 through the LF cam 25 and the sheet feed gear 26 to feed the recording sheet by a distance corresponding to the line space. On the other hand, the spacing cam 36 is disengaged from the rack 37 to return the hammer holding block 35 to the first space of the next line by the resilience of the return spring 38.

At time $t_3$ between the time $t_2$ and the time $t_4$, the solenoid coil 11*a* is de-energized to allow the sheet feed lever 30 to return to the home position. At time $t_5$ by which the LF clutch gear 22 is turned one full turn, the lower projection 33 of the sheet feed lever 30 engages the projection 23 of the LF clutch gear 22 to check the LF clutch gear 22. During the rotation of the LF clutch gear 22, the next printing operation is withheld.

Thus, the single electromagnetic clutch 10 controls the selector lever 15 and the sheet feed lever 30 for type selection, printing, sheet feed and returning the hammer holding block 35. Accordingly, the microprinter of the present invention requires a reduced space for accommodating the components thereof, and hence the microprinter can be formed in a compact construction.

Although the invention has been described in its preferred form with a certain degree of particularity, obviously many changes and variations are possible therein. It is therefore to be understood that the present invention may be practiced otherwise than specifically described herein without departing from the scope and spirit thereof.

What is claimed is:

1. A structure comprising:

a type belt carrying a plurality of type;

a driving belt pulley operatively coupled to said type belt for driving said type belt;

a motor operatively coupled to said driving belt pulley for driving said driving belt pulley;

a type selecting ratchet wheel coupled with said driving belt pulley such that said ratchet wheel rotates with said driving belt pulley;

a hammer disposed for pressing a selected type of said type belt to print said selected type on a recording sheet disposed adjacent to said type belt;

a main printing gear operatively coupled to said motor and said hammer to drive said hammer for printing;

a selector lever disposed adjacent to said type selecting rachet wheel and said main printing gear for selectively engaging said type selecting ratchet wheel or alternately said main printing gear;

a single armature plate operatively coupled with said selector lever;

an electromagnetic clutch operatively coupled with said armature plate for driving said armature plate; and a sheet feed lever operatively coupled with said armature plate, wherein said sheet feed lever controls the movement of a recording sheet with respect to said type belt.

* * * * *